US005655527A

United States Patent [19]

Scarberry et al.

[11] Patent Number: 5,655,527

[45] Date of Patent: Aug. 12, 1997

[54] RESPIRATORY MASK WITH FLOATING SEAL RESPONSIVE TO PRESSURIZED GAS

[75] Inventors: Eugene N. Scarberry, Trafford; Patrick M. Handke, Monroeville, both of Pa.

[73] Assignee: Respironics Inc., McMurray, Pa.

[21] Appl. No.: 472,015

[22] Filed: Jun. 6, 1995

Related U.S. Application Data

[62] Division of Ser. No. 254,408, Jun. 3, 1994, Pat. No. 5,492,116 .

[51] Int. Cl.[6] ..... A62B 9/00; A62B 7/00

[52] U.S. Cl. ..... 128/206.24; 128/205.25; 128/206.21

[58] Field of Search ..... 128/204.18, 204.23, 128/204.26, 205.25, 206.24, 206.26, 206.27, 206.21, 206.23, 206.28, 207.11; 2/410, 416, 424

[56] References Cited

U.S. PATENT DOCUMENTS

| | | | |
|---|---|---|---|
| H397 | 1/1988 | Stark | 128/206.24 |
| 2,465,973 | 3/1949 | Bulbulian | 128/206.24 |
| 2,671,445 | 3/1954 | Charbonnel | 128/141 |
| 3,330,273 | 7/1967 | Bennett | 128/206.24 X |
| 3,545,436 | 12/1970 | Holloway | 128/206.24 |
| 3,680,555 | 8/1972 | Warncke | 128/206.24 |
| 4,296,746 | 10/1981 | Mason, Jr. et al. | 128/201.25 |
| 4,402,316 | 9/1983 | Gadberry | 128/201.15 |
| 4,440,163 | 4/1984 | Spergel | 128/205.13 |
| 4,739,755 | 4/1988 | White et al. | 128/206.12 |
| 4,905,683 | 3/1990 | Cronjaeger | 128/202.22 |
| 4,971,051 | 11/1990 | Toffolon | 128/208.26 |
| 4,989,596 | 2/1991 | Macris et al. | 128/208.28 |
| 5,069,205 | 12/1991 | Urso | 128/201.24 |
| 5,243,971 | 9/1993 | Sullivan et al. | 128/205.25 |

FOREIGN PATENT DOCUMENTS

| | | | |
|---|---|---|---|
| 873113 | 6/1942 | France | 128/206.24 |
| 1282992 | 12/1961 | France | 128/206.24 |
| 153869 | 2/1938 | Germany | 128/206.24 |
| 954758 | 12/1960 | Germany | 128/206.24 |
| 40-435 | 8/1965 | Germany | 128/206.24 |
| 37712 | 3/1936 | Netherlands | 128/206.24 |
| 209470 | 7/1940 | Switzerland | 128/206.24 |
| 150232 | 9/1920 | United Kingdom | 128/206.24 |
| 425152 | 3/1935 | United Kingdom | 128/206.24 |
| 428338 | 5/1935 | United Kingdom | 128/206.24 |
| 447729 | 5/1936 | United Kingdom | 128/206.24 |

*Primary Examiner*—V. Millen
*Assistant Examiner*—Eric P. Raciti
*Attorney, Agent, or Firm*—J. Stewart Brams

[57] ABSTRACT

A respiratory mask adapted to confront the face of a user in a manner to float with respect to the user's face on a cushion of gaseous medium contained within the mask for user breathing, the gaseous medium being contained within the mask by a flexible seal means carried by the mask and maintained in sealing engagement with the user's face while providing essentially no structural support for the mask with respect to the user's face.

5 Claims, 1 Drawing Sheet

RESPIRATORY MASK WITH FLOATING SEAL RESPONSIVE TO PRESSURIZED GAS

This is a divisional of application Ser. No. 08/245,408 filed on Jun. 3, 1994, now U.S. Pat. No. 5,492,116 issued Feb. 20, 1996.

BACKGROUND OF THE INVENTION

In the art of respiratory masks it is well known to provide masks of various sorts as part of a gaseous medium delivery system for delivering a respiratory gas to the airway of a user. Such masks commonly have included a mask shell member which confronts and encloses a portion of the user's face, and a perimeter seal which engages the user's face to seal the interface between the user's face and the mask shell. The seal is particularly important for those uses in which the mask serves to deliver a gaseous medium at elevated pressure to the user. Typically, at any given time the gas pressure is intended to be at a specified magnitude. Management of the gas pressure magnitude would be seriously complicated by improper sealing and resulting uncontrolled leakage from the mask.

The technology is replete with examples of such masks, including U.S. patents and publications U.S. Pat. No. 3,680,555, U.S. Pat. No. 3,545,436, H397, U.S. Pat. Nos. 4,989,596, 4,440,163, 4,971,051, 2,671,445, 4,905,683, 4,739,755, 4,296,746, and U.S. Pat No. 3,330,273. Each of the cited documents discloses a mask structure for the delivery of a gaseous medium to a user, or a seal structure for such a mask. In particular, some of the cited art discloses generally inturned seal elements extending about the perimeter of a mask shell.

Respiratory masks often are utilized on a relatively long term continuous basis so that user comfort and tolerance become crucial considerations in the mask design. To maximize user comfort and tolerance, the mask must be of minimal weight. It also needs to be well ventilated to carry moisture away from the facial area of the user. In addition, the shape, form and material of the mask (i.e. whether opaque versus transparent) can significantly influence the likelihood of a claustrophobic reaction by the user. Of course, it is highly desirable that the tendency toward such a reaction be minimized.

The magnitude of force by which conventional masks are retained upon a user's face can also influence mask tolerance because continuous application of even relatively small magnitude mechanical force on a user's face can lead to superficial trauma such as bruising and skin breakdown.

BRIEF SUMMARY OF THE INVENTION

The present invention contemplates a novel and improved respiratory mask and seal system reduces the incidence of superficial trauma, increases mask tolerance for users prone to claustrophobic reaction, provides improved user comfort through an optimized mask support system, and in other ways enhances user acceptance of the mask thereby affording improved prospects for the success of a regimen of treatment utilizing the mask.

The invention contemplates more specifically a transparent formed mask shell preferably having a perimeter portion which extends continuously about an enclosure portion of the mask such that the enclosure portion confronts and covers substantially the entire face of a user and the perimeter portion resides adjacent side portions of the user's face, side portions being not only lateral sides but upper portions of the forehead and portions of the area beneath the chin. A relatively wide and highly flexible inturned seal is secured to the mask shell, preferably adjacent a peripheral edge of the mask and extending inwardly of the mask shell enclosure portion to define an opening to receive a user's face.

A head gear for retaining the mask includes an arrangement of flexible retention straps which cooperate with other head gear elements and the mask shell to retain the mask shell in confronting relation with respect to a user's face, but not in forcible engagement therewith. The elevated pressure of a gaseous medium such as a breathing gas is provided within the confines of the mask enclosure portion, when fitted on a user's face, to maintain the mask seal in sealed engagement with the user's face. The elevated pressure gas also supports or floats the mask on a pressure cushion in closely spaced relation with respect to the user's face to the extent permitted by the mask retention straps. An effective pressure seal thus is maintained even though the mask shell itself floats free of the user's face and neither the mask shell nor the seal forcibly engages the same under mechanical loading of the retention head gear as in conventional respiratory masks.

It is therefore one object of the invention to provide a novel and improved respiratory mask.

A further object of the invention is to provide a respiratory mask which is effective to optimize mask acceptance and tolerance by the user through enhancement of seal member sealing properties and mask support, and reduction of the likelihood of user claustrophobic reaction.

A more specific object of the invention is to provide a respiratory mask having a generally semi-rigid mask shell with an inturned, flexible pre-formed seal which is adapted to sealingly engage a user's face for pressure actuated sealing under the impetus of gaseous medium pressure maintained within the mask for breathing by a user, the pressure of gaseous medium within the mask both actuating the mask seal and supporting the mask shell, preferably in closely spaced relationship with respect to the user's face.

These and other objects and further advantages of the invention will be more readily appreciated upon consideration of the following detailed description and the accompanying drawings, in which.

Figure 1:
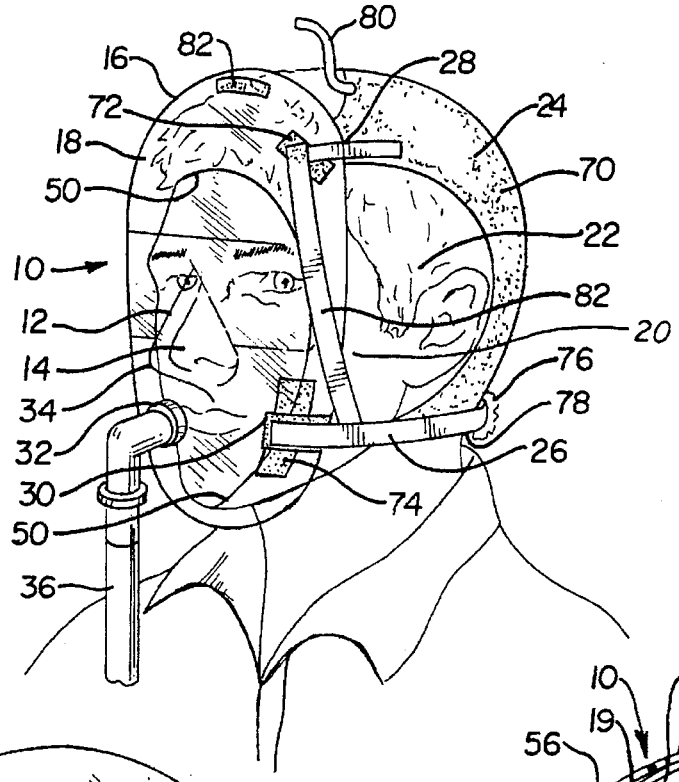
FIG. 1 is a forward quarter view of a user wearing a respiratory mask constructed according to one presently preferred embodiment of the instant invention.

There is generally indicated at 10 in FIG. 1 a respiratory mask constructed according to one presently preferred embodiment of the instant invention. The mask 10 includes a semi-rigid, fully transparent full face shell 12 having an enclosure portion 14 which is encompassed by a peripheral portion 16. By semi-rigid, it is meant that shell 12 is formed as shown from relatively thin section material such as suitable plastic material. The material and section thickness of the mask shell are chosen to ensure the mask shell will retain its formed shape in use under the gas pressure loading it must contain.

At the same time, the mask shell material, section thickness and structural details are selected to ensure the mask shell can deform under relatively small mechanical loads in order to absorb small shock loads, and to enhance user comfort in use, which may include use by a person in sleep moves or shifts body position continually and unpredictably while asleep. Such movements may place mechanical loads on the mask shell, as when the user's head turns to one side or the other.

A relatively high degree of flexibility for the mask shell thus is desired in order to minimize mechanical load transfer between the mask shell and the patient's head at the points where the mask and head most closely approach each other. The stiffness or rigidity of the mask shell also is to be sufficient that the shell does not significantly deform under the pressure loads contained therewithin in use. That is, the mask shell is to be sufficiently stiff that it will not act essentially as a pressure variation buffer or pressure accumulator in response to gas pressure loading applied therein between the mask shell and the user's face.

A flexible seal membrane 18 extends about mask shell periphery 16 and inwardly of enclosure portion 14 for engagement with side portions 20 of the face of a user 22. Mask shell 12 is retained with respect to the face of user 22 with seal 18 engaging facial side portions 20 by means of a head gear 24 which includes a system of retention straps that are connected to exterior portions of mask shell 12 by any suitable means such as, for example, known hook and loop fasteners like VELCRO™ brand tape fasteners. The head gear 24 is described in further detail hereinbelow.

An opening 32 is formed in mask shell 12, preferably below a nose confronting portion 34 thereof, to receive a supply end of a gas supply conduit or tube 36 for delivery of a breathing gas into enclosure portion 14 of mask shell 12 and thence to the airway of user 22.

Figure 2:
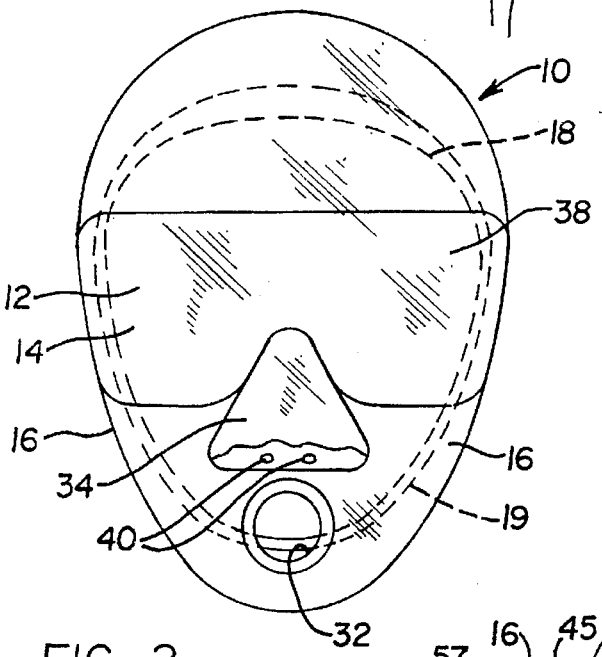
FIG. 2 is a front elevation of the mask of FIG. 1 with the gaseous medium delivery tubing removed for clarity.
Figure 3:
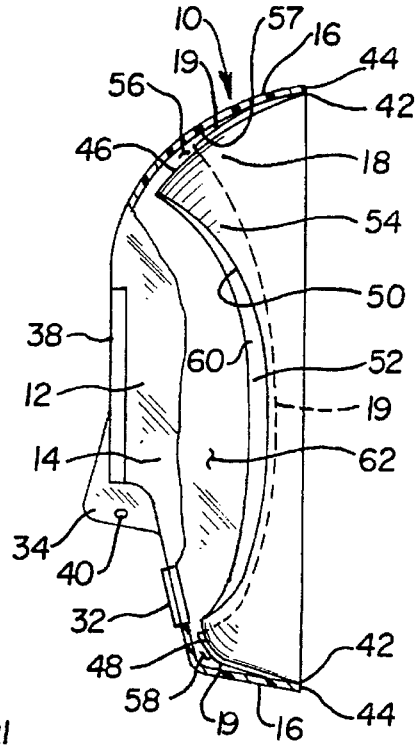
FIG. 3 is a partially broken away side elevation of the mask of FIG. 2 showing one embodiment of the mask seal.

Referring to FIGS. 2 and 3, mask shell 12 is constituted of a full-face encompassing, generally concave shell forming the enclosure portion 14 to enclose substantially the entire frontal area and side portions of the user's face within the confines of mask peripheral portion 16. Although the entire shell 12 preferably is transparent, the form of the shell includes in particular a visual sight portion 38 which generally confronts the eyes of the user 22. Sight portion 38 may be of such proportion, dimensions, and optical quality as to permit user 22 substantially unrestricted vision when mask 10 is in place on the user's face. By contrast, the balance of mask shell 12 outside the sight portion 38 also is preferably transparent but may be of somewhat lesser optical quality as only the peripheral vision of the user typically would receive light images through such mask portions of lesser optical quality. The overall transparency of the mask shell 12, including the higher optical quality sight portion 38 and the perhaps lesser optical quality balance of the mask shell 12, enhances user tolerance and reduces prospects of a claustrophobic reaction.

In an alternative embodiment of the sight portion 38, the perimeter thereof may be expanded and/or blended into the surrounding portions of the mask shell in order to avoid creating the sensation for the user of an artificially restricted perimeteral boundary to the field of vision. Of course it is also contemplated that the sight portion 38 may be suitably formed to accommodate a user wearing eye glasses. The bounds and dimensions of the sight portion 38 may be varied accordingly. Specifically, the frontal expanse of sight portion 38 may be suitably curved in the lateral and/or vertical directions rather than flat.

Nose enclosing portion 34 includes one or more vent apertures 40 to permit one mode of ventilation of the facial areas enclosed by the mask for such purposes as carrying away moisture and exhaled air. In particular, vents 40 permit an essentially continuous flow of air from the mask shell under elevated pressure maintained within the mask. The continuous gas flow through vents 40 thus serves to flush moisture and carbon dioxide-rich exhaled air out of the mask shell.

In an alternative embodiment the vents 40 may be located approximately at the location corresponding to the opposed upper corners of sight portion 38, for example generally confronting or adjacent to the user's temples. This alternative embodiment results in exhaust air flow washing across the interior surface of sight portion 38 enroute to the vents 40 to thereby continuously purge moisture from the sight portion and discourage fogging thereof.

Additional ventilation paths may include controlled leakage between seal member 18 and the user's face. This also carries away moisture, specifically the moisture that would otherwise accumulate in the seal interface with the user's face. This aspect of the invention is further described hereinbelow.

Figure 4:
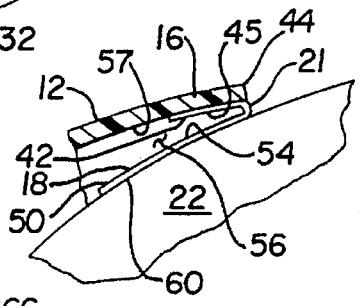
FIG. 4 is a fragmentary portion of FIG. 3 showing details of the mask seal.

In FIGS. 3 and 4 seal 18 is shown in greater detail as a preferably continuous band of very flexible, flappable seal material affixed as at 42 in continuous attachment on an inner surface portion 45 of mask shell 12 adjacent an outer peripheral edge 44 of the mask periphery 16. Seal member 18 extends inwardly of mask shell 12 from edge 44 and is pre-formed as indicated at 46 and 48 to generally follow the contours Of a user's face. For example, as shown at 46 the seal 18 is formed to curve downwardly generally following the arch of a user's forehead whereas at 48 the seal member extends inwardly of the mask and then curves upwardly in a predetermined form to encompass a user's chin. The balance of seal 18 is similarly pre-formed generally to the contours of those portions of a user's face which the corresponding parts of seal 18 confront and engage in use.

Seal 18 extends inwardly of mask shell 12, as described hereinabove, to terminate at an inner periphery or edge 50 that extends in a continuous line to form an opening 52. The opening 52 receives the user's face in the manner most clearly shown in FIG. 1. As such, seal member 18 includes an inner surface 54 which, when mask 10 is fitted on user 22, is spaced from the adjacent inner surface 57 of mask shell 12 such as shown at 56 and 58. The seal 18 thus is not only contoured as described hereinabove to conform generally with adjacent portions of the user's face, but in addition to maintain a spacing from mask shell surface 57. The space 56, 58 preferably extends continuously about the seal 18 intermediate shell inner surface 57 and seal inner surface 54.

Seal 18 also includes an outer surface 60 which is engagable with the face of user 22 to seal against the user's face and thereby contain a gaseous medium at elevated pressure within the confines 62 of mask shell enclosure portion 14.

Seal membrane 18 is of such material and structure as to permit the sealing thereof with a user's face to be maintained by pressure within space 62 acting upon seal membrane inner surface 54. Accordingly, as noted seal 18 is highly flexible and flappable, and will flex essentially without resistance into sealed contact with the user's face upon application of elevated pressure to surface 54. By virtue of spacings 56, 58, a gaseous medium under pressure contained within space 62 always has access to surface 54 in order to effect such sealing. It will be noted that seal member 18 encompasses a progressively smaller area as it extends inwardly of mask shell 12 such that when the mask is placed over a user's face, portions of seal membrane 18 can contact the user's face at many points about surface 60 thereby providing partial sealing engagement. The seal membrane then readily flexes into full sealing engagement with the user's face upon application of gaseous medium pressure to surface 54.

In order to further facilitate sealing action, a backing membrane 19 may extend intermediate seal 18 and the confronting inner surface 57 Of mask shell 12. The backing membrane or element 19 is preferably preformed to generally follow the contours of a user's face. It is also preferably quite flexible relative to the mask shell, although not so flexible as the seal membrane 18. Further, backup member 19 is essentially non-extensible under mechanical loads encountered in placing the mask in its use position on the face of user 22. Member 19 thus serves to initially form portions of seal membrane 18 to the contours of the user's face upon application of the mask to the user's face. In order to maintain a desired spacing between mask shell 12 and 'the user's face even along the perimeter of mask 12, the member 19, although affixed to the inner periphery of mask shell 12, is otherwise spaced from the inner surface 57 of mask shell 12 as shown in FIG. 3. Accordingly, on placing the mask in the use position on a user's face, the member 19 allows seal 18 to be confined between backup member 19 and confronting portions of the user's face without deforming backup member 19 outwardly into engagement with mask shell surface 57.

In a contemplated mask structure excluding member 19, for example as shown in FIG. 4, the mask may rely exclusively on proper form and interior dimensions of the seal membrane 18 to bring seal 18 into conforming engagement with confronting portions the user's face upon application of the mask to the user's face.

Referring further to FIGS. 3 and 4, in either embodiment, that is with or without the member 19, seal 18 is preferably an inturned flap seal as shown in FIG. 4 wherein the seal membrane is attached as at 42 to an inner peripheral portion of mask shell 12. The flap seal 18 then turns essentially 180° adjacent the perimeteral edge 44 of mask shell 12 and extends inwardly therefrom under the periphery of shell 12 to confront portions of the user's face. The pressure of gas within the mask ensures the application of positive pressure within space 56 thus providing a sealing force that seals membrane 18 against the face of user 22. The positive pressure within space 56 also causes a connecting portion of seal member 18 to bulge outwardly between the mask shell perimeteral edge 44 and the user's face as shown at 21 in FIG. 4. This effect, and the requisite flexibility of seal membrane 18, permit the sealed engagement with the user's face to be maintained while at the same time maintaining a spacing between the mask shell 12 and the user's face.

In reality, of course, the positive pressure force within space 56 which maintains seal 18 in sealed engagement with the user's face varies along a gradient extending between the innermost extent 50 of seal 18, and the outer balloon portion 21 thereof. Adjacent innermost extent 50, the positive pressure in space 56 will have access to both the inner surface 54, and the opposed surface of seal 18 which engages the user's face. By contrast, at a point closely adjacent balloon portion 21 where seal membrane 18 engages the user's face, the positive pressure within space 56 acts on one side of seal membrane 18 and atmospheric pressure acts on the opposed side of seal membrane 18.

In general, the preferred sealing effect will be that for which the pressure available between seal membrane 18 and the user's face to oppose the positive pressure within space 56 will be just sufficient to permit the pressure in space 56 to maintain membrane 18 in gas sealing engagement with the user's face without imposing any undue or unnecessary excess of pressure force on the user's face. It is believed this mode of sealing occurs where the pressure forces on the inner and outer surfaces of seal membrane 18 are balanced, and that this would occur generally along a line of sealing, rather than across a surface area of sealing.

Mask 10 preferably is to be available in a selection of sizes, each being designed to fit a range of user face sizes so that the mask which provides the best fit of seal member 18 upon the face of the user may be selected. The seal 18 should just lightly contact the user's face with the periphery 16 of shell 12 spaced from corresponding adjacent portions of the user's face. The seal 18 then flexes to move surface 60 into sealing engagement with the user's face upon application of gaseous medium pressure to surface 54 and without any application of mechanical pressure or force to the face of the user by mask shell 12.

Accordingly, the outermost edge 44, and more generally the periphery 16, of mask shell 12 is maintained in spaced relationship with respect to the user's face in actual use of mask 10. The intervening pressurized balloon portion 21 of seal 18 serves to both maintain the spacing of the mask shell periphery from the user's face and to lightly cushion relative movement of the mask shell with respect to the user's face. The pressure of the gaseous medium within space 62 tends to float the mask shell 12 in confronting but non-contacting relation with the user's face, the mask being retained by means of the head gear 24.

Moreover, the perimeter of mask shell 12 is spaced generally in a lateral direction from adjacent portions of the user's face so that the gas pressure force acting within space 56 also is directed generally in a lateral direction against the user's face and the mask shell perimeter. Accordingly, head gear 24 sustains retention forces only as necessary to balance the pressure force of contained gas distributed over the frontal area of the user's face. The mask perimeter and adjacent portions of the user's face are laterally opposed. No supporting structure is needed at the mask perimeter to engage the user's face for support of reaction forces corresponding to the head gear retention forces. This is so because the lateral component of the head gear retention force, which is directed in a front-to-back direction, is essentially nil. In this sense, head gear 24 does not mechanically clamp the mask shell 12 against the user's face, but merely supports in its juxtaposed position adjacent to the user's face where it floats freely on a cushion of the pressurized breathing gas medium.

The sealing engagement of seal 18 on the user's face will be maintained even if the user shifts head position dramatically in sleep, for example by turning the head or the body to one side or the other. The positive pressure maintained within the mask acts continuously on the highly flexible seal membrane 18 to reconfigure the seal continuously thus adapting it to large shifts in the user's face position.

The pressure of the gaseous medium delivered via tube 36 into space 62 thus provides multiple utilitarian functions in addition to being breathed by the user of mask 10 in a variety of applications including, for example, CPAP (Continuous Positive Airway Pressure) therapy. The gas pressure acts on inner surface 54 to provide sealing engagement of seal outer surface 60 with confronting portions of a user's face. The contained positive gas pressure also provides a lifting or separating force which serves to separate the mask shell 10 from the face of the user to the extent permitted by head gear 24 so that the mask shell 12 floats on a cushion of gas pressure with peripheral portion 16, and more generally the entire mask shell, maintained in spaced relationship with respect to the user's face as above described.

Note that the gas pressure is maintained even in the presence of continuous exhaust flow from vents 40 and/or other exhaust flow paths described herein). The mask shell thus exerts no mechanical force whatever on the face of the user. All the retention and positioning forces applied to the mask are constituted of gas pressure distributed over the face of the user within the confines of shell 12, and the restraining forces of head gear 24 which are distributed over the back of the user's head and upper neck.

As noted above, the weight of the mask shell 12 is preferably to be minimized in order to also minimize the magnitude of the necessary supporting forces, including gas pressure, which are exerted upon the head of the user. These supporting forces, together with the force which maintains seal membrane 18 in sealed engagement with the user's face, are developed entirely by the gas pressure within space 62. In order to minimize the magnitude of pressure necessary to develop the required forces, the surface areas of seal inner surface 54, and the surface area the mask seal bounding space 62 preferably are made large enough that the described floating support of the mask shell 12 and sealed engagement of seal membrane 18 on the user's face are achieved with minimal magnitudes of gaseous medium pressure applied within space 62. Thus, the magnitude of gas medium pressure within space 62 may be selected from a wider range of low pressure values because the lower limit of pressure required to support and seal the mask on the user's face has been reduced to a minimum.

As noted above, vent openings 40 permit the continuous flow of pressurized gaseous medium within space 62 out of mask shell 12 to the ambient atmosphere. Such ventilation of space 62 is desired since the user is both inhaling from space 62 and exhaling to it. For enhanced or additional ventilation of space 62, supply conduit 36 may incorporate a non-rebreathing valve or a controlled leak to permit a major part of the exhaled gas to backflow in conduit 36 and thence via the non-rebreathing valve or leak to the ambient atmosphere. Alternatively, the same or a similar vent valve may be provided in a suitable formed channel means passing between mask shell 12 and confronting portions of the user's face across the periphery 16 of mask shell 12.

Still another alternative is to provide a controlled leakage flow path for ventilation and exhalation flow between seal outer surface 60 and the confronting portions of the user's face to thereby afford controlled exhaust flow or leakage past the seal interface. A seal interface which permits such controlled exhaust flow or leakage is thus regarded, in common with a completely gas tight seal interface, as a seal in the context of this invention.

The combined volume of space 62, the connected conduit 36, and other portions of the gas supply system which are open to space 62 preferably is to be large enough that controlled exhaust or leakage past seal membrane 18 via the interface between surface 60 and the user's face will not materially affect the ability to control the gas pressure within space 62 as the leakage or ventilation flow path configuration changes with user facial movement. The working volume of space 62 and connected gas supply elements such as conduit 36 also is to be large enough, and provided with sufficient exhaust ventilation capability such as described hereinabove, that patient pressure control capability will not be adversely influenced by inhalation and exhalation.

In order to provide for the above described controlled ventilation or leakage of flow between surface 60 and confronting portions of a user's face, seal membrane 18 is preferably a very thin and flexible seal membrane as noted above, made of suitable plastic or similar material in thin enough section to be highly flexible and able to flex substantially without resistance into sealing engagement with the user's face under the influence of even very limited gas pressure applied to surface 54. In order to enhance seal flexibility and its ability to conform to the contours of the user's face, and to accommodate controlled leakage across the seal, the membrane 18 also should be of a structure that it can distend in the direction of its own plane, preferably without any significant mechanical stretching of the seal material.

Figure 5:
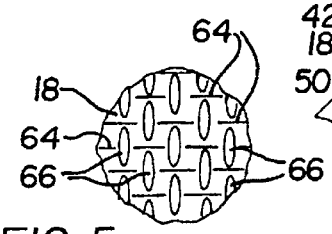
FIG. 5 is a detailed view showing one pattern of surface texturing for the mask seal.
Figure 6:
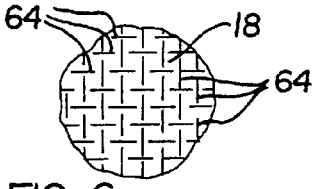
FIG. 6 is a detailed view showing an alternative pattern of surface texturing for the mask seal.

For example, one structure for seal membrane 18 which may be used to accomplish these purposes is shown in FIG. 5 as a flexible, thin, textured surface seal membrane embossed with parallel rows of broken, spaced apart crease line segments 64 running in a given direction, and parallel rows of embossed, elongated patches 66 running in a direction generally perpendicular to the direction of crease lines 64. In an alternative structure as shown in FIG. 6, the mutually perpendicular embossed elements both may be broken crease lines or crease line segments 64. Other embossed structural formations may be provided on seal membrane 18, for example, a waffle or similar pattern of embossing which, like the patterns of FIGS. 5 and 6, will be evident on both of seal surfaces 54 and 60 due to the extremely thin section of seal membrane 18. Additional seal membrane texture patterns may include a zig-zag pattern or a pattern of concentric circles. An alternative seal structure may include a thin sheet form expanse of foam material such as plastic or rubber foam with the cell structure at the opposed surfaces of the seal member forming the beneficial surface texture. Such a foam seal may be of either an open cell or closed cell structure. Either alternative will permit controlled leakage along the interface between the seal and the user's face to provide benefits relative to user comfort and tolerance as described herein.

The embossing of seal membrane 18, as in FIGS. 5 and 6 for example, affords an additional degree of membrane flexibility beyond the inherent flexibility of the membrane material, thus enhancing seal flexibility and providing a limited degree of stretching or distension without significant mechanical deformation of the membrane material. This further reduces resistance of the seal material to molding or conforming to the user's face, for improved efficacy of sealing. The textured seal surface 60 provides a network of limited capacity ventilation or exhaust flow paths across confronting portions of a user's face to permit a continuous flow of pressurized gaseous medium from space 62 to pass along the seal interface to the ambient atmosphere. This provides ventilation of the seal interface to carry away moisture and enhance comfort for the user wherever the face is engaged by seal 18.

Head gear 24 is preferably comprised of an expanse of flexible soft fabric mesh material 70 cut to extend over portions of the top and back of the user's head behind the ears, and down to the upper portion of the user's neck. Preferably non-extensible retention straps 28 and 26, respectively, are affixed suitably to respective upper and lower side portions of mesh expanse 70 to extend forwardly. Free ends of the respective straps 28 and 26 are selectively attachable to cooperating fastener patches 72 and 74, for example patches of VELCRO™ brand tape, affixed to respective upper and lower side portions of mask shell 12.

A soft band of fleece-like material 76 is affixed adjacent the bottom margin 78 of mesh 70 and extends thereon from side to side between the attachment points of the lower retention straps 26. Finally, for additional support other similar retention straps 80 are suitably attached to the portion of the forward margin of mesh 70 positioned atop the user's head. Only one of straps 80 is shown in FIG. 1 although a pair of such straps spaced laterally apart may preferably be employed. The straps 80 also are attachable to a corresponding upper portion of mask shell 12, for example by crossing over one another and being retained by a cooperating upper central VELCRO™ brand patch 82 or similar attachment carried by mask shell 12.

There may be occasions when the user needs to quickly remove the mask apparatus 10 from the face. For example, in spite of all efforts to avoid claustrophobic reaction, such may still occur in some users. Additionally, in the event of system breakdown or improper operation easy removal of the mask shell 12 is desired. Accordingly, adjacent each lateral side of head gear 24 a connecting strap 82 extends generally vertically between the respective retention straps 26 and 28 and is connected thereto as by sewn stitching at or near their respective free ends. Accordingly, the user may very quickly disconnect the structure retaining mask shell 12 with respect to his head by merely grabbing either or both of straps 82 and pulling outward away from the head. This will quickly release mask shell 12 from all retention points except the connection of straps 80 to patch 82. The user may then quickly and easily remove mask shell 12 from the face.

Application of mask apparatus 10 to a user's face may commonly begin by initiating gas flow via the opening 32 into the confines 62 of mask shell 12. The mask shell 12 is then placed in confronting position with respect to the user's face and moved into adjacent relationship therewith to bring seal 18 into juxtaposition with confronting portions of the user's face. The decreasing cross-sectional area of the total leak and exhaust flow paths from space 62 will cause the continuing inflow of gas to develop a positive pressure within space 62 thus moving seal 18 into sealed engagement with the user's face as above described. The positive pressure developed within space 62 also serves to inflate seal balloon portion 21 to provide the bias for maintaining a spacing between mask shell perimeter 16 and the user's face. Of course, the positive pressure within space 62 also acts on the interior surface of the mask shell 12 and the user's face thus imposing a parting or separating force therebetween. These pressure forces are small owing to the relatively small magnitude of gas pressure within space 62; nevertheless, the force is sufficient, with regard to the weight or mass of mask shell 12, to establish the floating relationship of mask shell 12 with respect to the user's face. Minor movements of mask shell 12 with respect to the user's face, whether vertical, side to side, or front to back, all can be accommodated by flexure of seal membrane 18 in the balloon region 21 thereof.

With mask shell 12 thus confronting the user's face and seal 18 sealed against facial portions as above described, mesh 70 is laid across the back and top of the user's head, and straps 26, 28 and 80 are brought forward for attachment to the corresponding attachment patches of mask shell 12. In order to support the mask shell, mesh 70 need not be stretched tight nor are the retention straps pulled tight for engagement with mask shell 12. The purpose of head gear 28 is purely to retain mask shell 12 in its floating status with respect to the user's face. No mechanical retaining force is required of head gear 20 except to balance the pressure force developed within space 62. In particular, the head gear 24 is not utilized to either draw mask shell 12 peripheral portions into engagement with the user's face (which would effectively eliminate the cushioning and adjustability afforded by seal balloon portion 21) or to force seal 18 into sealing engagement with the user's face (which in any event is unnecessary since the positive pressure within space 62 provides the force for seal engagement).

According to the above description, we have invented a novel and improved respiratory mask which utilizes the elevated pressure of a breathing gas supply for the purposes of supporting the mask in spaced relationship with respect to the user's face and maintaining a seal membrane in sealed engagement with the user's face to thereby seal the interior space of the mask from the ambient atmosphere.

Of course, we have contemplated various alternative and modified embodiments of the invention, and certainly such would also occur to others versed in the art, once apprised of our invention. For example, the nose portion 34 of mask shell 12 or other surface portions thereof may be otherwise configured, for example by complete exclusion of the nose portion 34, so long as the overall form of mask shell 12 provides sufficient clearance within space 62 to receive the user's face; a gas flow deflector may be provided in or adjacent to supply opening 32 in order to disperse gas flowing into space 62 to thereby enhance comfort by eliminating any sensation of an air blast or stream being directed at the user's face; a mouth piece or similar type retention structure affixed to an interior portion of space 62 may be utilized to retain the mask adjacent a user's face in lieu head gear 24, the mouth piece alternative being in the nature of a bite element or other suitable structure formed to engage upon the user's dentition; the seal attachment at 42 in FIG. 4 may alternatively be an attachment to the outer periphery of the mask shell; and the like. In addition, structural alternatives may include a formed seal portion to bridge temple portions of eye glasses worn by a user, and such cooperating structural elements as tubular elastomeric elements fitted about the eye glass temples to cushion the eye glass temples and to provide a more suitable surface against which seal membrane 18 may seal where it bridges the eye glass temples.

Still further, the mask shell may be of a material, or may include a periphery of a material that permits the mask to be formed to a desired shape to more closely match the shape of the user's face. For example, a generally oval mask shell could be formable to a more elongated or more rounded form to conform more closely with the shape of a particular user's face. One contemplated structure for such a formable mask shell would include a metal band of aluminum, for example, affixed to the perimeter of a readily formable plastic mask shell.

In view of the wide range of potential alternative or modified structures, it is our intention that the invention should be construed broadly and limited only by the scope of the claims appended hereto.

We claim:

1. In a patient interface device for directing pressurized breathing gas from a respiratory apparatus to a user, the interface device having a peripheral portion adapted to be disposed in spaced relation with respect to a user's face, a seal apparatus for maintaining a floating seal between the patient interface and a user's face wherein the seal apparatus is responsive to pressurized gas acting thereon and to movement of the user to reshape for balancing forces between the pressurized gas and the user's face, said seal apparatus comprising:

a seal member adapted to be carried by such a patient interface device and formed to be coextensive with such a peripheral portion of the interface device and to extend inwardly thereof;

said seal member being made of flappable and flexible material, and having a generally concave form to generally follow the contours of a user's face;

means for moving said seal member between an inner, non-sealing position and an outer sealing position for engagement with a user's face, said means for moving comprising a pressurized gas force receiving inner surface of said seal member, an outer face-engaging surface of said seal member, and the flappable and flexible material of said seal member, wherein, responsive to the application of said pressurized breathing gas to said inner surface of said seal member, the flappable and flexible material of said seal member moves outward to move said face engaging surface into engagement with a user's face.

2. The seal apparatus as set forth in claim 1 wherein said seal member is formed as a thin section flexible membrane with at least portions of said outer surface including integrally formed texture means.

3. The seal apparatus as set forth in claim 2 wherein said texture means includes a pattern means formed on at least said outer surface.

4. The seal apparatus as set forth in claim 3 wherein said pattern means includes plural crease line segments, at least some of said crease line segments being parallel with respect to ones of said crease line segments and skewed with respect to others of said crease line segments.

5. In a patient interface device for directing pressurized breathing gas from a respiratory apparatus to a user and including a seal member which is adapted to be carried by such a patient interface device the improvement comprising:

said seat member being formed as a thin section membrane having a generally concave form which generally follows the contours of a user's face and having a pressurized gas force receiving inner surface and a face-engaging outer surface which is movable outwardly into engagement with a user's face in response to pressurized gas acting on said inner surface to maintain a floating seal between the patient interface device and a user's face by the response of the seal member to the pressurized gas acting thereon as the seal member maintains a balance between the forces of the pressurized gas and the forces of engagement with the user's face, and said seal member including on at least portions of said face-engaging surface an integrally formed texture means.

* * * * *